United States Patent [19]

Kimura et al.

[11] Patent Number: 4,806,304

[45] Date of Patent: Feb. 21, 1989

[54] FREE CUTTING STEEL

[75] Inventors: Atsuyoshi Kimura; Sadayuki Nakamura; Makoto Saito, all of Aichi, Japan

[73] Assignee: Daido Tokushuko Kabushiki Kaisha, Aichi, Japan

[21] Appl. No.: 744,907

[22] Filed: Jun. 17, 1985

Related U.S. Application Data

[63] Continuation of Ser. No. 608,622, May 9, 1984, abandoned.

[30] Foreign Application Priority Data

May 9, 1983 [JP] Japan ..... 58-80550
May 9, 1983 [JP] Japan ..... 58-80549

[51] Int. Cl.[4] ..... C22C 38/60

[52] U.S. Cl. ..... 420/84; 420/86; 420/87; 420/88; 164/459; 164/473

[58] Field of Search ..... 75/123 AA, 123 B, 123 D, 75/123 F, 123 G, 124 B; 164/359, 473; 420/84–88

[56] References Cited

U.S. PATENT DOCUMENTS

| | | | |
|---|---|---|---|
| 3,973,950 | 8/1976 | Itoh et al. | 75/123 AA |
| 4,236,939 | 12/1980 | Bhattacharya et al. | 75/123 AA |
| 4,255,188 | 3/1981 | Riekels | 75/123 AA |
| 4,279,646 | 7/1981 | Kato et al. | 75/123 AA |
| 4,326,886 | 4/1982 | Abeyama et al. | 75/123 AA |
| 4,524,819 | 6/1985 | Yoshimura | 164/473 |
| 4,719,079 | 1/1988 | Katayama et al. | 420/84 |

*Primary Examiner*—Deborah Yee
*Attorney, Agent, or Firm*—Armstrong, Nikaido, Marmelstein & Kubovcik

[57] ABSTRACT

Sulfur-containing free-cutting steel may have an improved machinability and fewer defects by adding certain amounts of Te, Pb and Bi to prevent elongation of sulfide inclusion particles, and by lowering Al-content to decrease $Al_2O_3$ of oxide inclusions or by lowering O-content to decrease large $Al_2O_3$ inclusion particles. The free-cutting steel may be produced by continuous casting.

3 Claims, No Drawings

FREE CUTTING STEEL

This application is a continuation of application Ser. No. 608,622, filed May 9, 1984, now abandoned.

BACKGROUND OF INVENTION

1. Field of the Invention

The present invention concerns an improved free-cutting steel and process for producing.

2. State of the Art

In the production of a low carbon sulfur free-cutting steel called "ultra free-cutting steel", the general practice has been to increase the oxygen content of the steel so that the shape of the sulfide inclusion particles may be spheroidal. On the other hand, a higher oxygen content causes a large amount of oxide inclusion, which increases surface defects of the steel, resulting in lowered strength and poor appearance. If the oxygen content is reduced by using a deoxidizing agent, the sulfide inclusion particles become elongated, and machinability decreases.

SUMMARY OF THE INVENTION

One object of the present invention is to provide a sulfur-containing free-cutting steel with a low carbon in which the sulfide inclusion particles are large and spheroidal in shape so that good machinability may be maintained and so that a steel with few defects may be produced.

Another object of the present invention is to provide a suitable method for making the above-mentioned improved steel.

One aspect of the present invention is based on our discovery that, if not only S, but also Te, Pb and Bi are added to the steel and the Al content is lowered to decrease Al-based inclusion in the oxided inclusions, there may be obtained, even if the oxygen content is within a certain range, a steel of good machinability and fewer defects.

Another aspect of the present invention is also based on our discovery that, if not only S, but also Te, Pb and Bi are added to the steel to control the elongation of the sulfide inclusion particles, and Al is used as the deoxidizing agent for RH (radio high frequency) degassing or LF (ladle furnace) refining to lower the oxygen content so as to decrease large $Al_2O_3$ inclusion particles, there may be obtained a steel of good machinability and fewer defects.

DETAILED DESCRIPTION OF PREFERRED EMBODIMENTS

The first embodiment of the present invention is a steel which comprises C: up to 0.2%, Si: up to 0.2% and Mn: up to 2.0%; P: not higher than 0.1%, N: not higher than 0.02%, and Al: not higher than 0.002%; and further comprises S: 0.04 to 0.50%, Te: 0.002 to 0.50%, Pb: 0.01 to 0.4% and Bi: 0.01 to 0.40%, Te+Pb+Bi being 0.20% or more; and O: 0.0040 to 0.030%, with the balance being substantially Fe; MnS inclusion particles having a length (L) of 5 micron or more, a width (W) of 2 micron or more and an aspect ratio (L/W) of 5 or less being at least 50% of all the MnS inclusion particles in the steel; and $Al_2O_3$ being in average 15% or less of the oxide inclusion.

The second embodiment of the present invention is a steel which comprises C: up to 0.2%, Si: up to 0.2% and Mn: up to 2.0%; P: not higher than 0.10%, N: not higher than 0.02%, and O: not higher than 0.010%; Al: more than 0.002% up to 0.060%; and further comprises S: 0.04 to 0.50%, Te: 0.002 to 0.50%, Pb: 0.01 to 0.40% and Bi: 0.01 to 0.40%, Te+Pb+Bi being 0.20% or more, and the balance being substantially Fe; MnS inclusion particles having a length (L) of 5 micron or more, a width (W) of 1 micron or more and an aspect ratio (L/W) of 1 or less being at least 50% of all the MnS inclusion particles in the steel; and a percentage of large 5 micron or longer $Al_2O_3$ particles being not higher than 0.01% of the oxide inclusion.

The roles of the alloying elements and the significance of the composition are as follows:

C: up to 0.2%

Carbon impairs suitable hardness of the steel. In this kind of free-cutting steel, 0.2% of carbon is the upper limit for good machinability. A content not exceeding 0.1% is preferable.

Si: up to 0.2%

If the amount of Si exceeds 0.2%, the effect of alloying Te+Pb+Bi, in addition to S, decreases, and the hardness of the material becomes too high.

Mn: up to 2.0%

From the viewpoint of machinability, the lower the content of Mn, the better. In order to improve hot workability, Mn is added in an amount up to 2.0%.

P: not higher than 0.10%

P is favorable for machinability. However, too high a content causes hardening of the matrix and decreased hot workability.

N: not higher than 0.02%

Like P, N hardens the matrix, and therefore, the content should not exceed the above upper limit.

S: 0.04 to 0.50%

S takes a major role of improving machinability. A content of 0.04% or higher is required, and the upper limit, 0.5%, is chosen in view of the influence on hot workability.

Te: 0.002 to 0.50%, Pb: 0.01 to 0.40%, Bi: 0.01 to 0.40%, Te+Pb+Bi: 0.20% or higher.

The above elements form low melting-point inclusions to spheroidize the sulfide inclusion particles. The effect becomes remarkable as a result of the compounding these additives. To ensure this remarkable effect, it is necessary to add these elements in amounts in the above respective ranges and at least 0.20% in total. The upper limits are chosen from the viewpoint of hot workability.

Al: in the first embodiment, up to 0.002%, and in the second embodiment, 0.002 to 0.06%

As noted above, it is one of the features of the steel in the first embodiment to contain a very small amount of Al. The content is controlled to be 0.002% or less so that the amount of $Al_2O_3$ in the oxide inclusion, which shortens tool life, may be within the limit mentioned later.

In the second embodiment, Al of less than 0.002% is insufficient to be effective as an deoxidation agent.

On the other hand, addition of more than 0.060% cannot produce further effects as an deoxidation agent and increases the amount of $Al_2O_3$.

O: in the first embodiment, 0.004 to 0.030%, and in the second embodiment, 0.010% or less.

In order to decrease $Al_2O_3$, which is a high-hardness oxide hastening tool abrasion, it is preferable to lower the oxygen content. The deoxidation should be so through that the oxygen content may be 0.010% or less. If the oxygen content exceeds this limit, there will be a significant amount of the large $Al_2O_3$ inclusion particles. A preferable content is 0.005% or less.

With respect to the shape and size of the sulfide inclusion particles, the nearer the shape is to be a spheroid and the larger their amount, the better. In the first embodiment, if the percentage (volume) of large spheroidal sulfide particles having a length of 5 micron or more, a width of 2 micron or more and an aspect ratio (L/W) of 5 or less is 50% or more of the total sulfide inclusion, then the machinability-improving effect will reach a satisfactory level. In the second embodiment, if the percentage (volume) of large spheroidal sulfide inclusion particles having a length of 5 micron or more, a width of 1 micron or more and an aspect ratio of 7 or less is 50% or more of the total sulfide inclusion, then the machinability-improving effect will reach a satisfactory level.

The oxide inclusions are, in the first embodiment, mainly MnO, $SiO_2$ and FeO. If $Al_2O_3$ is contained in a large amount, it significantly abrades cutting tools due to its high hardness. Al content should be, therefore, as low as possible in the above-noted range to limit the percentage of $Al_2O_3$ in the oxide inclusions to not higher than 15%. In the second embodiment, the main oxide inclusion is $Al_2O_3$ because of Al-deoxidation. Large $Al_2O_3$ inclusion particles having a diameter of 5 micron or more seriously shorten tool life, and the amount should be 0.01% or less.

The above-described free-cutting steel of the present invention may be produced by any process. It is one of the merits of the present free-cutting steel that a steel of high quality may be produced by continuous casting, which is being widely practiced because of high productivity. Generally, because continous casting is carried out under a cooling rate higher than that of conventional ingot-casting, the sulfide inclusion particles in the steel tend to be fine, and it has been difficult to improve machinability of the continuously-cast steel. According to the present invention, the sulfide inclusion particles become large spheroids, and continuous casting may be employed. In the case of producing the free-cutting steel by continuous casting, it is preferable to add the above-noted machinability-improving elements, S, Te, Pb, Bi, to the molten steel in a tundish, because the yields of these elements are high, and floating up of $Al_2O_3$ clusters is promoted.

EXAMPLES

The following examples illustrate the present invention and prove the merits thereof.

Example I and Control I

Steels of the compositions shown in Table 1 were produced in a 70 ton arc furnace. The machinability-improving elements were added to the molten steels in the manners indicated below:

A: added into the furnace or into a ladle,

B: added by the Gazzar method, i.e., thrown onto the surface of the molten steel exposed by inert-gas bubbling, C: added into a nozzle, and D: added into a tundish.

The molten steels were cast by the methods below:

Examples 1, 2 and 3, and Controls A, B and C . . . ingot-casting (6.5 ton)

Examples 4, 5, and control D . . . continuous casting.

The cast steels were subjected to rough rolling, wire rolling, and drawing and straightening to form round rods of 11 mm diameter.

The samples were analyzed to determine the shape of the sulfide inclusion particles and the percentage of $Al_2O_3$ in the oxide inclusions. The shape of the sulfide inclusion particles was analyzed with an image-analyzer using test pieces prepared for microscopic observation, and the oxide inclusion particles were analyzed with an EPMA. The term "large spheroidal sulfide inclusion particle" means, as mentioned above, the particle having a length of 5 micron or more, a width of 2 micron or more, and an aspect ratio (L/W) of 5 or less. The percentage is expressed by volume as mentioned above. It is known that the volume percentage corresponds to the areal percentage observed by the analysis, and therefore, the data of the areal percentage are shown in Table 2.

TABLE 1

| No. | C | Si | Mn | P | S | Al | N | O | Te | Pb | Bi | Te + Pb + Bi |
|---|---|---|---|---|---|---|---|---|---|---|---|---|
| (Present Invention) | | | | | | | | | | | | |
| 1 | 0.06 | 0.012 | 1.00 | 0.065 | 0.311 (A) | 0.0010 | 0.009 | 0.0152 | 0.042 (C) | 0.252 (B) | 0.092 (C) | 0.386 |
| 2 | 0.11 | 0.005 | 1.25 | 0.44 | 0.250 (A) | 0.0007 | 0.011 | 0.0211 | 0.015 (B) | 0.200 (B) | 0.124 (B) | 0.339 |
| 3 | 0.15 | 0.008 | 1.14 | 0.055 | 0.273 (A) | 0.0015 | 0.008 | 0.0060 | 0.053 (C) | 0.340 (B) | 0.050 (C) | 0.443 |
| 4 | 0.08 | 0.152 | 1.30 | 0.075 | 0.350 (A) | 0.0005 | 0.006 | 0.0093 | 0.040 (D) | 0.280 (D) | 0.120 (B) | 0.440 |
| 5 | 0.09 | 0.010 | 1.21 | 0.068 | 0.314 (D) | 0.0008 | 0.007 | 0.0105 | 0.045 (D) | 0.295 (D) | 0.086 (D) | 0.426 |
| (Control) | | | | | | | | | | | | |
| A | 0.08 | 0.035 | 1.10 | 0.065 | 0.305 (A) | 0.0041 | 0.008 | 0.0350 | — | 0.250 (B) | — | 0.250 |
| B | 0.09 | 0.012 | 1.08 | 0.072 | 0.302 (A) | 0.0205 | 0.008 | 0.0030 | — | 0.150 (B) | 0.100 (B) | 0.250 |
| C | 0.10 | 0.052 | 1.15 | 0.052 | 0.296 (A) | 0.0015 | 0.005 | 0.0420 | 0.030 (C) | — | 0.050 (C) | 0.080 |
| D | 0.08 | 0.026 | 1.05 | 0.068 | 0.333 | 0.0092 | 0.009 | 0.0380 | — | — | — | — |

TABLE 2

| No. | Large Spheroidal Sulfide Inclusion Particles (%) | Average Diameter of Sulfide Inclusion (micron) | Average of Aspect Ratio L/W | $Al_2O_3$ in Oxide Inclusion |
|---|---|---|---|---|
| (Present Invention) | | | | |
| 1 | 72 | 5 | 3.5 | 3.0 |

TABLE 2-continued

| No. | Large Spheroidal Sulfide Inclusion Particles (%) | Average Diameter of Sulfide Inclusion (micron) | Average of Aspect Ratio L/W | $Al_2O_3$ in Oxide Inclusion |
|---|---|---|---|---|
| 2 | 81 | 6 | 3.2 | 2.1 |
| 3 | 78 | 6 | 3.8 | 0.9 |
| 4 | 84 | 4 | 2.9 | 1.5 |
| 5 (Control) | 77 | 5 | 3.0 | 1.8 |
| A | 24 | 1.5 | 6.0 | 15 |
| B | 32 | 1.2 | 5.9 | 58 |
| C | 35 | 1.6 | 5.3 | 3 |
| D | 5 | 0.8 | 13 | 25 |

Machinability of the samples was determined. It was evaluated by means of processability when machined by a lathe, i.e., the extent of processing at a certain tool life, and expressed as indices based on the processability of the steel of "Control D", which had the lowest precessability. The data are given in Table 3. Table 3 shows the good machinability of the present steel.

TABLE 3

| No. | Machinability Index |
|---|---|
| (Present Invention) | |
| 1 | 200 |
| 2 | 200 |
| 3 | 220 |
| 4 | 195 |
| 5 | 197 |
| (Control) | |
| A | 130 |
| B | 140 |
| C | 135 |
| D | 100 |

Example II and Control II

The steels of the compositions shown in Table 4 were produced in a 70 ton arc furnace. The manners of adding machinability-improving elements are shown with the references which are the same as in Example 1.

The molten steels were cast by the following methods: Examples 6 and 7, and Controls E and F . . . ingot casting (6.5 ton).

Examples 8 and 9, and Control G . . . continuous casting. The steels were subjected to rough rolling, wire rolling drawing and straightening to form round rods of 11 mm diameter.

Table 5 shows the results of analyzing the shape of the sulfide inclusion particles and $Al_2O_3$ in the oxide inclusion particles. The shape of the sulfide inclusion particles was analized with an image analyzer using test pieces prepared for microscopic observation, and the $Al_2O_3$ was analyzed by Br-Met extraction analysis. The term "large spheroidal sulfide inclusion particle" means, also as mentioned above, the particle having a length of 5 micron or more, a width of 1 micron or more, and an aspect ratio (L/W) of 7 or less. The percentage is expressed by volume, as mentioned above.

TABLE 4

| No. | C | Si | Mn | P | S | Al | N | O | Te | Pb | Bi | Te + Pb + Bi |
|---|---|---|---|---|---|---|---|---|---|---|---|---|
| (Present Invention) | | | | | | | | | | | | |
| 6 | 0.08 | 0.05 | 1.12 | 0.071 | 0.308 (A) | 0.015 | 0.008 | 0.0034 | 0.040 (C) | 0.212 (B) | 0.095 (C) | 0.347 |
| 7 | 0.08 | 0.03 | 1.15 | 0.065 | 0.315 (A) | 0.030 | 0.009 | 0.0020 | 0.039 (B) | 0.253 (B) | 0.111 (B) | 0.403 |
| 8 | 0.09 | 0.15 | 1.08 | 0.058 | 0.324 (A) | 0.022 | 0.006 | 0.0030 | 0.042 (D) | 0.204 (D) | 0.150 (D) | 0.396 |
| 9 | 0.10 | 0.02 | 1.22 | 0.069 | 0.299 (A) | 0.008 | 0.005 | 0.0034 | 0.048 (D) | 0.199 (D) | 0.088 (D) | 0.335 |
| (Control) | | | | | | | | | | | | |
| E | 0.08 | 0.01 | 1.05 | 0.063 | 0.306 (A) | 0.002 | 0.009 | 0.0255 | — | 0.204 (B) | 0.071 (B) | 0.275 |
| F | 0.09 | 0.05 | 1.06 | 0.070 | 0.333 (A) | 0.015 | 0.005 | 0.0085 | 0.042 | — (C) | 0.055 (C) | 0.097 |
| G | 0.08 | 0.02 | 1.14 | 0.066 | 0.314 (A) | 0.010 | 0.008 | 0.0099 | — | — | — | — |

TABLE 5

| No. | Large Spheroidal Sulfide Inclusion Particles (%) | Average Diameter of Sulfide Inclusion (micron) | Average of Aspect Ratio L/W | $Al_2O_3$ of Diameter 5 or more |
|---|---|---|---|---|
| (Present Invention) | | | | |
| 6 | 76 | 5 | 4 | 0.0055 |
| 7 | 85 | 5 | 4 | 0.0030 |
| 8 | 82 | 5 | 4 | 0.0048 |
| 9 | 83 | 4 | 5 | 0.0053 |
| (Control) | | | | |
| E | 9 | 0.8 | 10 | 0.0044 |
| F | 15 | 0.7 | 9 | 0.0150 |
| G | 5 | 0.3 | 5 | 0.0162 |

TABLE 6

| No. | Machinability Index |
|---|---|
| (Present Invention) | |
| 6 | 200 |
| 7 | 209 |
| 8 | 200 |
| 9 | 199 |
| (Control) | |
| E | 125 |
| F | 118 |
| G | 100 |

We claim:

1. A free-cutting steel which consists essentially of C: up to 0.2%, Si: up to 0.2% and Mn: up to 2.0%; P: not higher than 0.1%, N: not higher than 0.02%, and Al: not higher than 0.002%; and further consists essentially of S: 0.04 to 0.50%, Te: 0.002 to 0.50%, Pb: 0.01 to 0.4% and Bi: 0.01 to 0.40%, Te+Pb+Bi being 0.20% or more; and O: 0.0040 to 0.030%, with the balance being Fe, or Fe and insubstantial amounts of materials which would not affect the properties of the free cutting steel;

and containing MnS inclusion particles wherein at least 50% of all MnS inclusion particles having a length (L) of 5 micron or more, a width (W) of 2 micron or more and an aspect ratio (L/W) of 5 or less; and containing oxide inclusions wherein an average of 15% or less of the oxide inclusion being $Al_2O_3$ said free-cutting steel having a machinability index of at least about 195.

2. A process for producing a free-cutting steel, which consists essentially of continuously casting a molten steel comprising C: up to 0.2%, Si: up to 0.2% and Mn: up to 2.0%; P: not higher than 0.1%, N: not higher than 0.02%, and Al: not higher than 0.002%; and further consists essentially of S: 0.04 to 0.50%, Te: 0.002 to 0.50%, Pb: 0.01 to 0.4% and Bi: 0.01 to 0.40%, Te+Pb+Bi being 0.20% or more; and O: 0.0040 to 0.030%, with the balance being substantially Fe, or Fe and insubstantial amounts of materials which would not affect the properties of the free cutting steel; to produce the cast steel in which at least 50% of all MnS inclusion particles have a length (L) of 5 micron or more, a width (W) of 2 micron or more and an aspect ratio (L/W) of 5 or less; and an average of 15% or less of the oxide inclusion being $Al_2O_3$ said free-cutting steel having a machinability index of at least about 195.

3. A process for producing a free-cutting steel according to claim 2, in which at least a portion or portions of S, Te, Pb and Bi are added to the molten steel in a tundish used for the continuous casting.

* * * * *